US010052784B2

(12) United States Patent
Chang

(10) Patent No.: US 10,052,784 B2
(45) Date of Patent: Aug. 21, 2018

(54) ROLLING MECHANISM OF A TRANSMISSION SHAFT IN A WOOD-WORKING MACHINE

(71) Applicant: KUANG YUNG MACHINERY CO., LTD., Taichung (TW)

(72) Inventor: Chih-Chou Chang, Taichung (TW)

(73) Assignee: Kuang Yung Machinery Co., Ltd., Taichung (TW)

( * ) Notice: Subject to any disclaimer, the term of this patent is extended or adjusted under 35 U.S.C. 154(b) by 5 days.

(21) Appl. No.: 15/355,512

(22) Filed: Nov. 18, 2016

(65) Prior Publication Data

US 2018/0141232 A1 May 24, 2018

(51) Int. Cl.
*B27B 5/32* (2006.01)

(52) U.S. Cl.
CPC ..... *B27B 5/32* (2013.01)

(58) Field of Classification Search
CPC ..... B27B 5/32; B26F 1/44; B26F 1/384
USPC ..... 83/698.41, 663, 698.11
See application file for complete search history.

(56) References Cited

U.S. PATENT DOCUMENTS

| | | | | |
|---|---|---|---|---|
| 4,926,730 A * | 5/1990 | Garrett | B26D 7/0006 | 384/620 |
| 5,297,464 A * | 3/1994 | Mayer | B26D 7/2621 | 83/425.4 |
| 7,168,502 B2 * | 1/2007 | Hartmann | B25F 5/001 | 173/104 |
| 2012/0216662 A1 * | 8/2012 | Yamada | B26F 1/384 | 83/331 |

* cited by examiner

*Primary Examiner* — Omar Flores Sanchez
(74) *Attorney, Agent, or Firm* — Muncy, Geissler, Olds & Lowe, P.C.

(57) ABSTRACT

A rolling mechanism of a transmission shaft in a wood-working machine is disclosed. A power mechanism provides the transmission shaft with a rotational force and is inside a box which is pivoted with a stabilizing rod to position a stabilizing plate. The rolling mechanism includes two plates and a positioning ring. The positioning ring is combined on the transmission shaft and rotates along with the transmission shaft. An outer periphery of the positioning ring is a concaved ring, and outer peripheries of the plates enter into the concaved ring so that the plates are clipped. An inner ring of the positioning ring positions the transmission shaft. By the plates of the stabilizing plate, the positioning ring of the transmission shaft rotates smoothly and is supported stably. The plates are outside the positioning ring and are assembled and dismantled easily.

3 Claims, 6 Drawing Sheets

ROLLING MECHANISM OF A TRANSMISSION SHAFT IN A WOOD-WORKING MACHINE

BACKGROUND OF THE INVENTION a) Field of the Invention

The present invention relates to a rolling mechanism of a transmission shaft in a wood-working machine, and more particularly to a rolling mechanism of a transmission shaft in a wood-working machine, wherein outer plates are used to stabilize and clip a pivoting ring, so that the transmission shaft which rotates synchronously can be operated without an internal bearing. The plates are completely assembled and dismantled outside the pivoting ring, which is faster and more convenient. In addition, when the transmission shaft rotates at a high speed, the vibration can be reduced and the quality in sawing wood can be improved.

b) Description of the Prior Art

It is known that a bearing is used in a machine to support a rotating object or an object which moves reciprocatively along a straight line. When other parts move relative to one another on a rotation shaft, the bearing is used to keep the rotation shaft at a center position and control the moving parts. The bearing can slide with respect to the rotation shaft, minimizing a friction force which results from the rotation of the rotation shaft and bringing the rotation shaft to the maximal efficiency. The bearing needs to be maintained regularly to prevent from early failure. The bearing needs to be lubricated, cleaned up and adjusted regularly to operate in a high frequency, so as to reduce a wear effect to a maximal degree. Therefore, the bearing can stabilize the rotation of the rotation shaft and support the rotation shaft, but the bearing is also a consumable product and needs to be replaced. In particular, as the bearing is assembled inside the rotation shaft, a period of time is needed to dismantle, replace and assemble the bearing.

A conventional transmission shaft in a wood-working machine is shown in FIGS. 1 to 4, wherein a power mechanism provides a transmission shaft 10 with a rotational force. The power mechanism is assembled inside a box 1 which is pivoted with a stabilizing rod 11. The stabilizing rod 11 positions a stabilizing plate 12 which is provided with a web space 121. A fixing ring 20 is connected between two ends of the web space 121, and an interior of the fixing ring 20 is provided with a bearing 21. The transmission shaft 10 penetrates the bearing 21 and is pivoted with the bearing 21. The fixing ring 20 includes a base ring 22, the bearing 21, a large ring 23, a small ring 24, a connection ring 25 and an outer ring 26. The bearing 21, the large ring 23, and the small ring 24 are assembled into the base ring 22 and are positioned by the base ring 22. The connection ring 25, on the other hand, is assembled into the base ring 22 on the other side. The base ring 22, the large ring 23, the small ring 24, the connection ring 25, and the outer ring 26 are locked together to clip and position a saw blade 13. In addition, the transmission shaft 10 penetrates the base ring 22, the bearing 21, the large ring 23, the small ring 24, the connection ring 25, the saw blade 13 and the outer ring 26, so that the bearing 21 can allow the transmission shaft 10 to rotate smoothly with respect to the stabilizing plate 12. The stabilizing plate 12 supports the transmission shaft 10 stably to deal with cutting all kinds of hard and soft wood.

Due to the abovementioned many complex parts, it will waste a lot of time and labor and will be very inconvenient in assembling and dismantling the bearing 21 of the conventional transmission shaft 10 in a wood-working machine. Furthermore, as the abovementioned bearing 21 of the conventional transmission shaft 10 in a wood-working machine is consumable, once the bearing 21 is worn out, the transmission shaft 10 will oscillate to affect the quality in cutting wood.

SUMMARY OF THE INVENTION

It wastes labor and time in assembling and dismantling the conventional bearing of the transmission shaft in a wood-working machine. The bearing is limited in the lifetime of use and is high in cost; whereas, the transmission shaft can oscillate easily to affect the quality in cutting wood.

Accordingly, the present invention discloses a rolling mechanism of a transmission shaft in a wood-working machine, wherein a power mechanism provides the transmission shaft with a rotational force, the power mechanism is assembled inside a box which is pivoted with a stabilizing rod, the stabilizing rod positions a stabilizing plate which is provided with a web space, and a rolling mechanism is pivoted between two ends of the web space. The rolling mechanism provides for connection with at least a saw blade and the transmission shaft.

The present invention is characterized in that the rolling mechanism is pivoted between two ends of the web space and includes at least two plates which are pivoted at two ends of the web space; and a positioning ring which is combined on the transmission shaft and rotates along with the transmission shaft, with an outer periphery of the positioning ring being provided at least with a concaved ring, outer peripheries of the plates entering into the concaved ring so that the plates can be clipped, and an inner ring of the positioning ring being used to position the transmission shaft.

Accordingly, the plates of the stabilizing plate enable the positioning ring of the transmission shaft to rotate smoothly and to be supported stably. In addition, as the plates are disposed outside the positioning ring, they can be assembled and dismantled easily.

The primary object of the present invention is to provide a rolling mechanism of a transmission shaft in a wood-working machine, wherein plural outer plates are used to stabilize and clip the positioning ring, such that the positioning ring which rotates synchronously can be operated without an internal bearing. Therefore, the plates can be completely assembled and dismantled outside the positioning ring, which is faster and more convenient.

Another object of the present invention is to provide a rolling mechanism of a transmission shaft in a wood-working machine that when the transmission shaft rotates at a high speed, vibration can be reduced through the plates, thereby increasing the quality and efficiency in sawing wood.

Still another object of the present invention is provide a rolling mechanism of a transmission shaft in a wood-working machine that when a section of the plate is worn out, the plate can re-rotate and position to another angle to escape from the wear area, so that only the non-friction area of the plate touches with the positioning ring, thereby prolonging the lifetime of use and increasing number of times of use of the plate.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
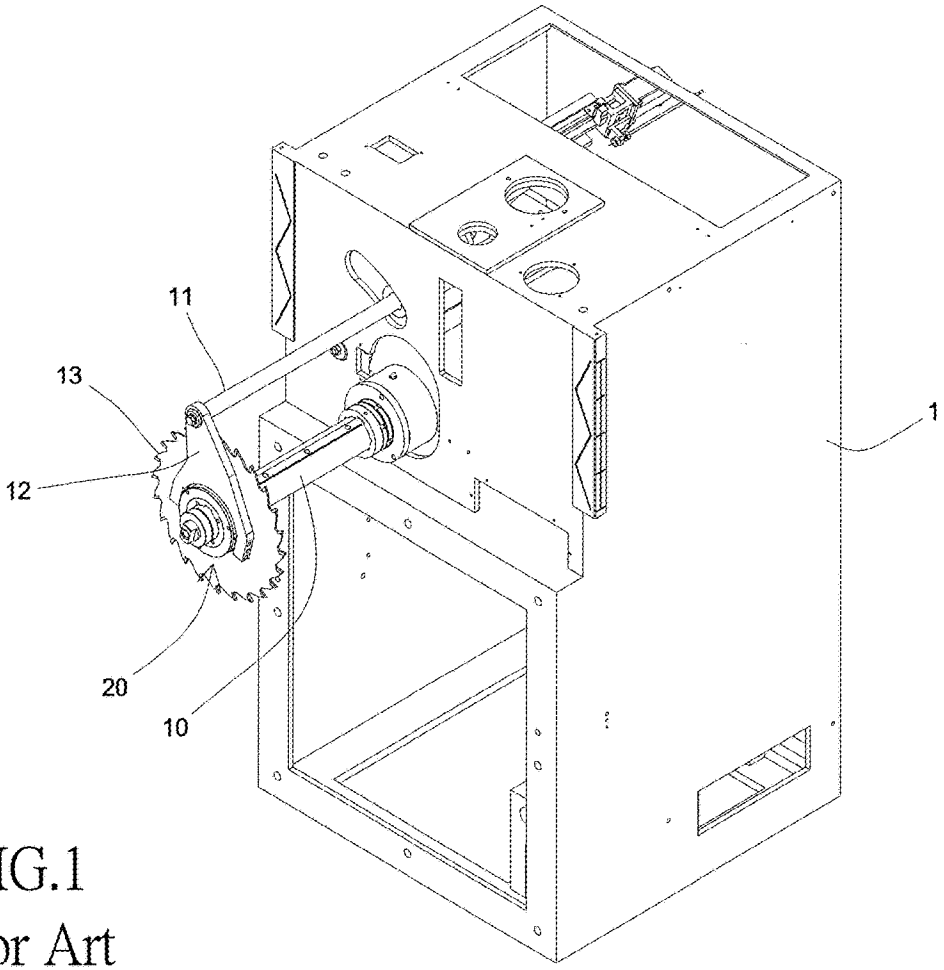
FIG.1 Prior Art
FIG. 1 shows a three-dimensional schematic view of a conventional wood-working machine and transmission shaft.
Figure 2:
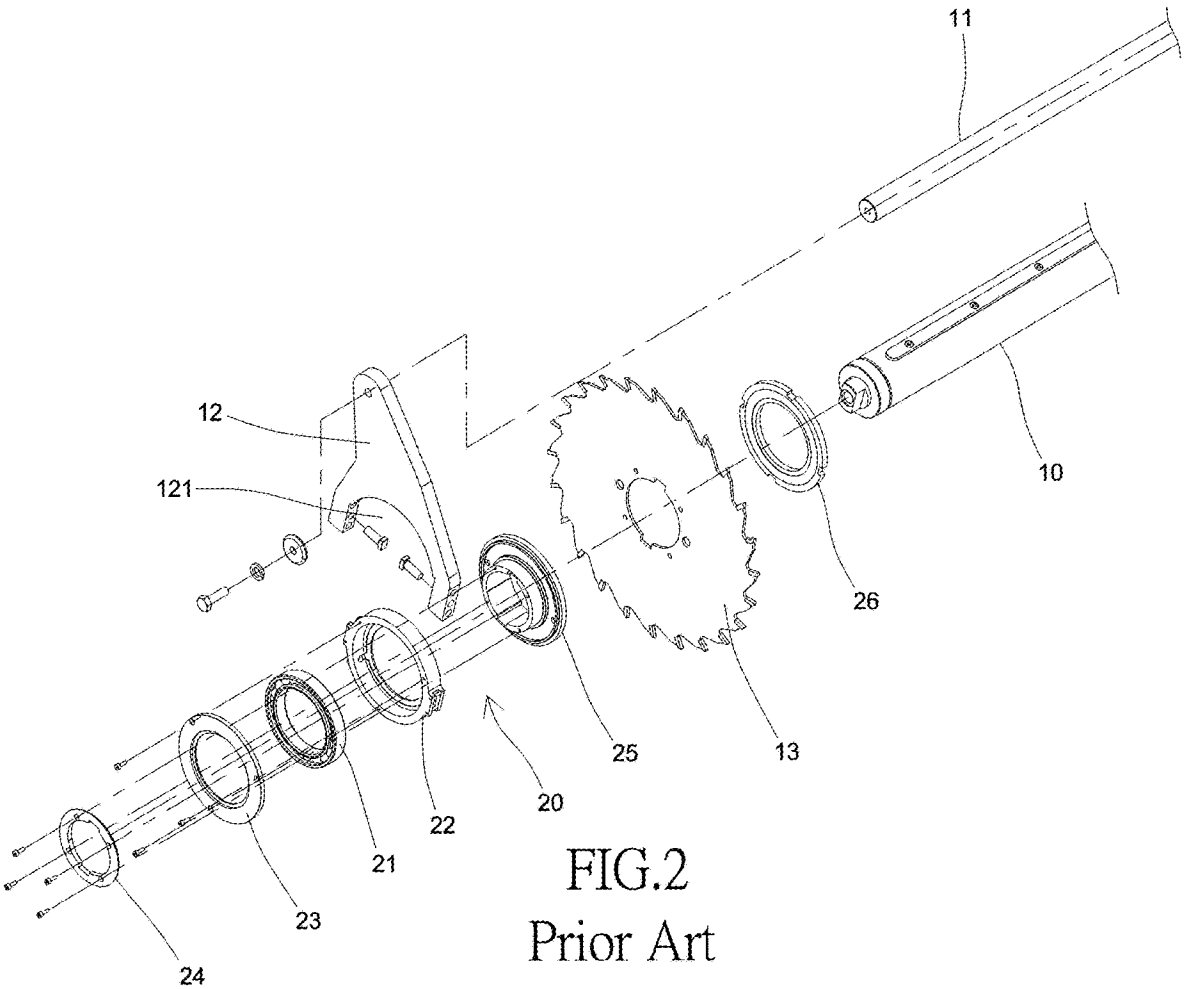
FIG.2 Prior Art
FIG. 2 shows a three-dimensional exploded view of a conventional fixing ring and transmission shaft.
Figure 4:
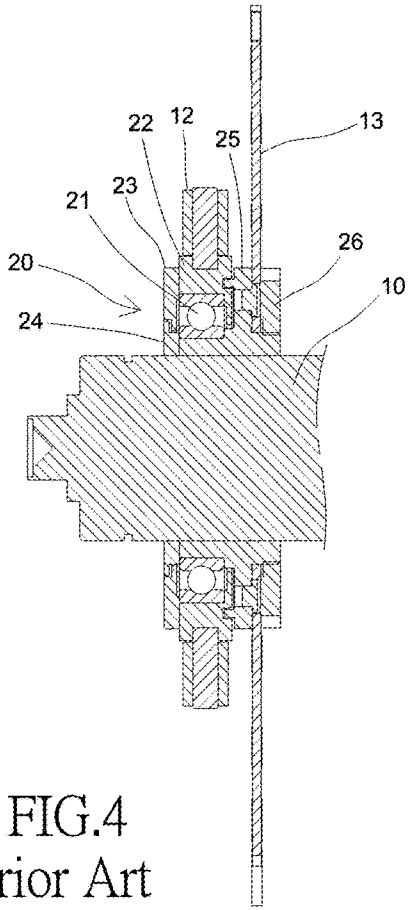
FIG.4 Prior Art
FIG. 4 shows a cutaway view of the conventional fixing ring and transmission shaft.
Figure 3:
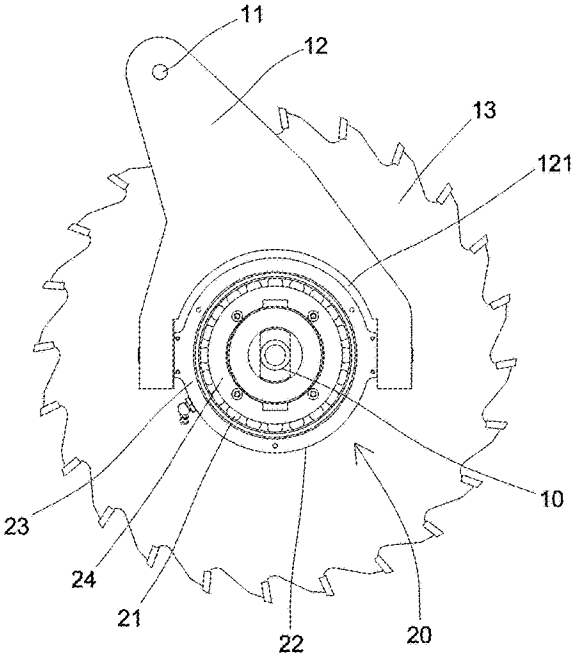
FIG.3 Prior Art
FIG. 3 shows a planar exploded view of the conventional fixing ring and transmission shaft.
Figure 5:
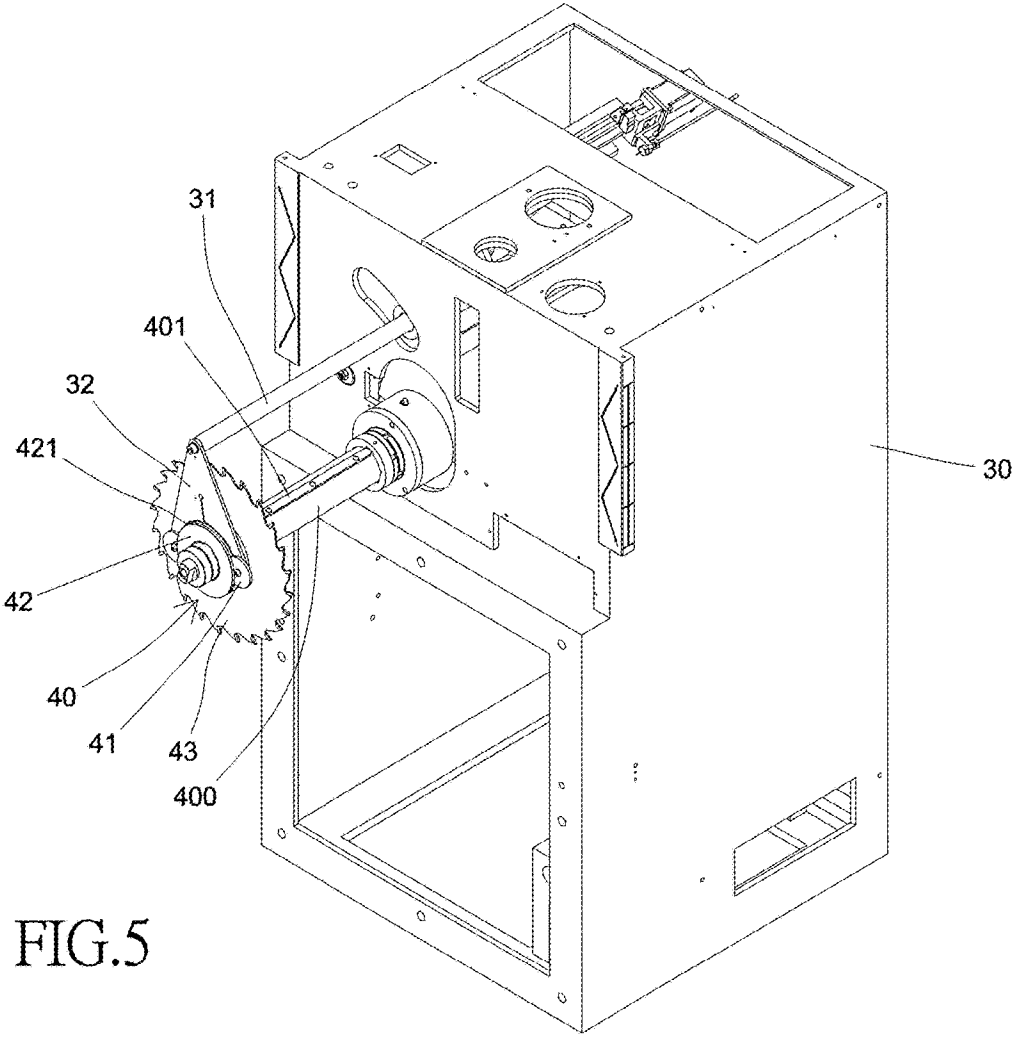
FIG. 5 shows a three-dimensional schematic view of the present invention.
Figure 6:
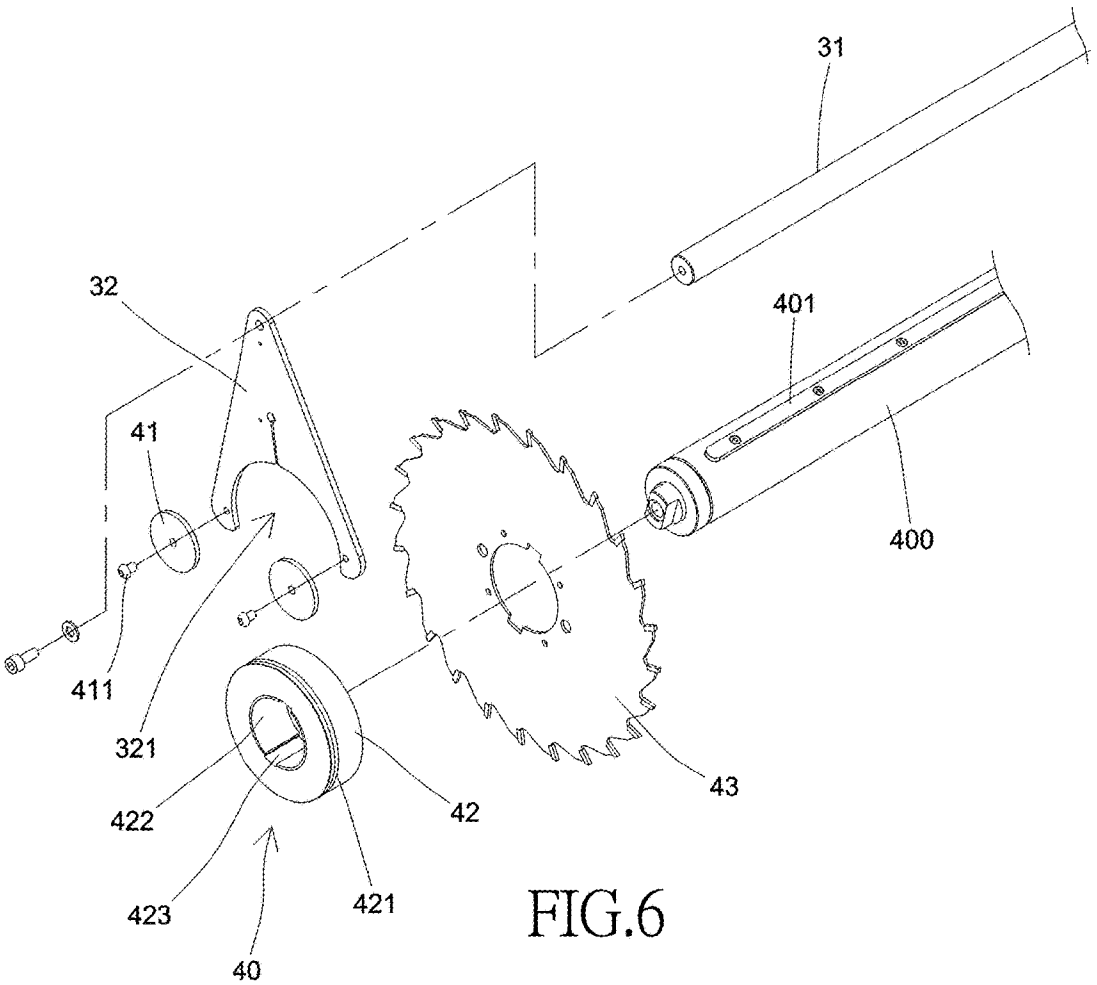
FIG. 6 shows a three-dimensional exploded view of the present invention.
Figure 8:
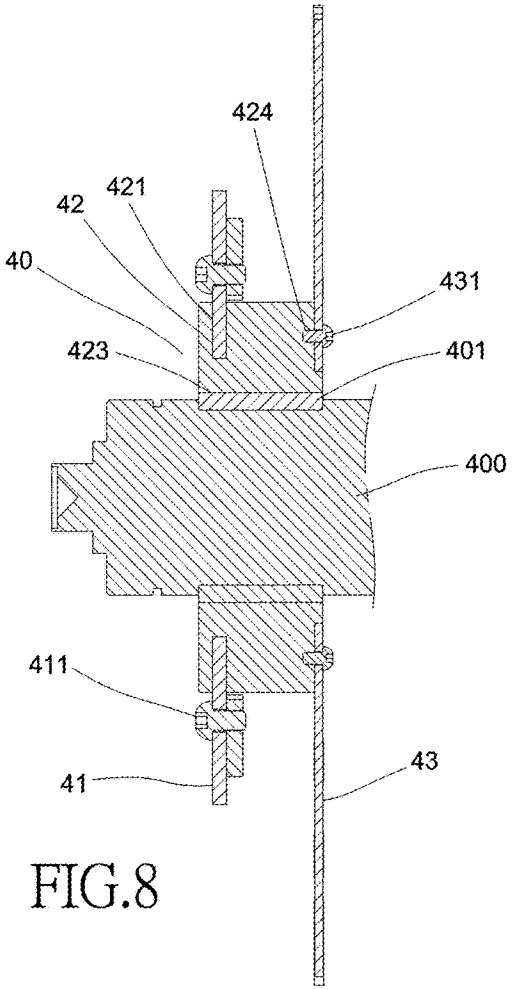
FIG. 8 shows a cutaway view of the present invention.
Figure 7:
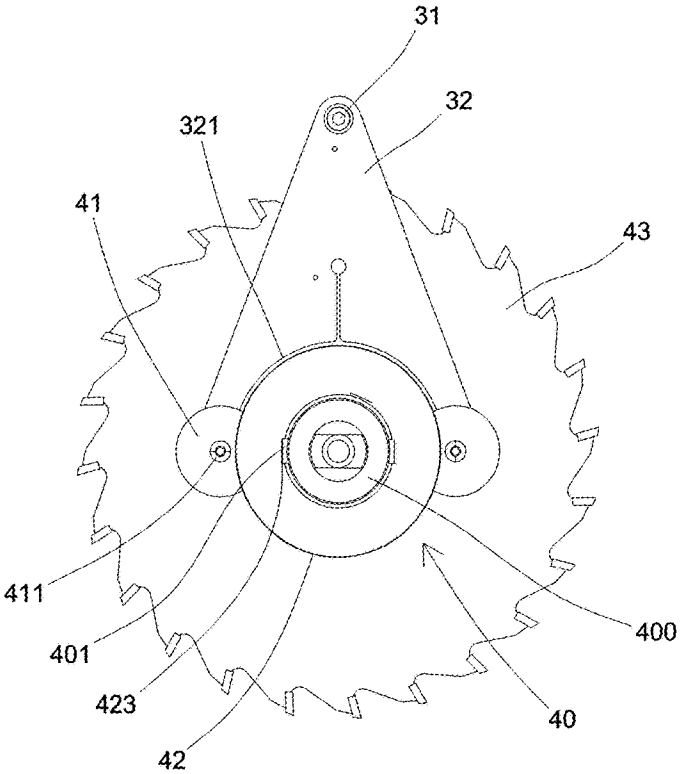
FIG. 7 shows a planar schematic view of the present invention.

Referring to FIGS. 5 to 8, the present invention discloses a rolling mechanism of a transmission shaft in a wood-working machine, wherein an interior of a box 30 is assembled with a power mechanism (normally a motor, which is not shown on the drawings), the power mechanism provides a transmission shaft 400 with a rotational force, the transmission shaft 400 is protruded out of the box 30, the interior of the box 30 is pivoted with a stabilizing rod 31, the stabilizing rod 31 is also protruded out of the box 30 to position a stabilizing plate 32 which is roughly in a triangular shape, below the stabilizing plate 32 is a web space 321, and a rolling mechanism 40 is pivoted between two ends of the web space 321 and provides for connection with at least a saw blade 43 and the transmission shaft 400.

The rolling mechanism 40 includes two plates 41 which are pivoted at two ends of the web space 321, and a positioning ring 42. The plates 41 are in a circular shape and are pivoted at two ends of the web space 321 with rivet pins 411. Two plates 41 can be arranged along a straight line or four plates 41 can be set up parallel in a two-by-two configuration.

The positioning ring 42 is combined on the transmission shaft 400 and rotates along with the transmission shaft 400. An outer periphery of the positioning ring 42 is provided at least with a concaved ring 421 which is a slot concaved in by a pre-determined depth. A width of the concaved ring 421 is equal to a width of the plate 41, so that an outer periphery of the plate 41 can enter into the concaved ring 421. An inner ring 422 of the positioning ring 42 is provided at least with a key way 423, a surface on the transmission shaft 400 is provided with a protruded key 401, and the key way 423 provides for latching with the protruded key 401, so that the inner ring 422 of the positioning ring 42 can position the transmission shaft 400. Positioning holes 424 (screw holes) are disposed on a side of the positioning ring 42, and the saw blade 43 is transfixed into the positioning holes 424 by screws 431 for positioning. An interior of the positioning ring 42 is not provided with any bearing part at all.

By the abovementioned structures, the present invention discloses a rolling mechanism 40 of a transmission shaft in a wood-working machine. When the power mechanism is activated to rotate the transmission shaft 400 at a high speed, the positioning ring 42 and the saw blade 43 on the transmission shaft 400 rotate synchronously. At this time, two plates 41 are clipped in the concaved ring 421 of the positioning ring 42, and do not rotate. As the plates 41 and the concaved ring 421 are pasted with lubricant, the positioning ring 42 can be limited stably. Therefore, the plates 41 of the stabilizing plate 32 enable the positioning ring 42 of the transmission shaft 400 to rotate smoothly and to be supported stably. In addition, the plates 41 are assembled and dismantled easily.

The present invention is provided with following advantages:

1. The plates 41 are easily assembled and dismantled. As the plates 41 are assembled outside the positioning ring 42 and the interior of the positioning ring 42 is not provided with any bearing part at all, therefore, there is no need to dismantle the internal of the positioning ring 42, and the plates 41 can be assembled and dismantled for replacement easily.
2. The positioning ring 42 is formed integrally and there is no need to dismantle the positioning ring 42 when changing the saw blade 43; therefore, the saw blade 43 can be assembled faster than the prior art.
3. The transmission shaft 400 is stabilized by at least two plates 41 and therefore is more stable than a conventional transmission shaft having a single internal bearing. In addition, the transmission shaft 400 oscillates at a smaller magnitude as compared to the conventional transmission shaft.
4. The plates 41 can be also configured as three sets (evenly distributed on the positioning ring 42 along a same straight line) or four sets (in a two-by-two arrangement), thereby even more stabilizing the transmission shaft 400 with an even smaller magnitude of oscillation.
5. The plates 41 are made of copper and the positioning ring 42 is made of iron. As the plates 41 are consumable, therefore, the cost is cheaper than that of a conventional bearing.
6. When there is a wear-out caused by the friction between the plate 41 and the positioning ring 42, the plate 41 can be re-positioned to another angle to escape from the wear area of the plate 41, with that only a non-friction area of the plate 41 touches with the concaved ring 421 of the positioning ring 42, thereby prolonging the lifetime of use of the plate 41.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A rolling mechanism of a transmission shaft in a wood-working machine, with that a power mechanism provides the transmission shaft with a rotational force, the power mechanism is assembled inside a box, the box is pivoted with a stabilizing rod, the stabilizing rod positions a stabilizing plate, the stabilizing plate is provided with a web space, the rolling mechanism provides for connection with a saw blade and the transmission shaft, a positioning ring is combined on the transmission shaft and rotates along with the transmission shaft; wherein the rolling mechanism comprises:

two plates which are movable mounted at two ends of the web space with rivet pins, with the plates being in a circular shape; and the positioning ring, with that an outer periphery of the positioning ring is provided with a concaved ring, outer peripheries of the plates enter into the concaved ring so that the plates are clipped, and an inner ring of the positioning ring provides for positioning the transmission shaft.

2. The rolling mechanism of a transmission shaft in a wood-working machine according to claim 1, wherein an inner periphery of the positioning ring is provided with a key way, a surface on the transmission shaft is provided with a protruded key, and the key way provides for latching with and positioning the protruded key.

3. The rolling mechanism of a transmission shaft in a wood-working machine according to claim 1, wherein a side of the positioning ring is provided with positioning holes to position the saw blade.

* * * * *